US008123069B1

(12) United States Patent
Mumaw et al.

(10) Patent No.: US 8,123,069 B1
(45) Date of Patent: Feb. 28, 2012

(54) HALO CUP HOLDER SYSTEM FOR DRINK COOLERS

(76) Inventors: Christopher Mumaw, Anaheim, CA (US); Kathryn Alice Mumaw, Anaheim, CA (US)

( * ) Notice: Subject to any disclaimer, the term of this patent is extended or adjusted under 35 U.S.C. 154(b) by 867 days.

(21) Appl. No.: 12/116,839

(22) Filed: May 7, 2008

Related U.S. Application Data

(60) Provisional application No. 60/916,494, filed on May 7, 2007.

(51) Int. Cl.
*B65D 90/00* (2006.01)

(52) U.S. Cl. ..... 220/694; 220/23.83; 220/23.4; 220/737; 220/738; 248/311.2; 294/141; 294/142; 294/143

(58) Field of Classification Search ..... 220/694, 220/23.83, 23.4, 737, 738; 248/311.2; 294/141, 294/142, 143
See application file for complete search history.

(56) References Cited

U.S. PATENT DOCUMENTS

| | | | | |
|---|---|---|---|---|
| 413,526 | A * | 10/1889 | Light | 15/264 |
| 1,334,664 | A | 3/1920 | Martin | |
| 1,349,473 | A | 8/1920 | Rosenthal | |
| 1,365,689 | A | 1/1921 | Haywood | |
| 1,758,005 | A | 5/1930 | Mangold | |
| 1,778,248 | A | 10/1930 | Doughty | |
| 1,840,138 | A | 1/1932 | Swallow | |
| 2,570,283 | A | 10/1951 | Stevens | |
| 2,909,300 | A | 10/1959 | Engram | |
| 3,211,329 | A * | 10/1965 | Boyd | 221/279 |
| 3,604,592 | A | 9/1971 | Bacon et al. | |
| 3,738,525 | A * | 6/1973 | Knapp | 220/23.4 |
| 4,323,172 | A | 4/1982 | Lim | |
| 4,993,611 | A | 2/1991 | Longo | |
| 5,275,305 | A | 1/1994 | Gross | |
| D348,772 | S | 7/1994 | Minx | |
| 6,517,036 | B1 | 2/2003 | Ramirez, Jr. | |
| 6,783,034 | B1 | 8/2004 | Brent | |
| 6,866,166 | B2 | 3/2005 | Mehes et al. | |
| 7,140,507 | B2 | 11/2006 | Maldonado et al. | |
| 7,328,818 | B2 | 2/2008 | Prabucki | |
| 2005/0263527 | A1 * | 12/2005 | Maldonado et al. | 220/592.2 |
| 2007/0062602 | A1 | 3/2007 | Alsberg et al. | |
| 2007/0095999 | A1 | 5/2007 | Dubois | |
| 2007/0187435 | A1 | 8/2007 | Quirk | |

* cited by examiner

*Primary Examiner* — Anthony Stashick
*Assistant Examiner* — Elizabeth Volz
(74) *Attorney, Agent, or Firm* — Knobbe, Martens, Olson & Bear, LLP

(57) ABSTRACT

A halo or ring system is described for holding cups for use with a large beverage cooler, such as those commonly used at sporting events. A first large ring has a diameter sized to fit around an upper portion of a beverage cooler, and a second ring is attached to the first ring. The second ring is sized to hold a stack of one or more cups for easy use with the beverage cooler.

11 Claims, 7 Drawing Sheets

HALO CUP HOLDER SYSTEM FOR DRINK COOLERS

RELATED APPLICATIONS

This application claims the benefit of U.S. Provisional Application Ser. No. 60/916,494 entitled Halo Cup Holder System for Drink Coolers filed May 7, 2007 which is hereby incorporated by reference in its entirety herein.

BACKGROUND OF THE INVENTION

1. Field of the Invention

The invention relates to portable storage systems for cups and beverage coolers.

2. Description of the Related Art

A variety of drink coolers are used, for example, at sporting events to refresh large numbers of people. These coolers hold varying amounts of liquid, often between three and ten gallons. Typically, someone wishing to get a drink uses a spigot located near the bottom of the cooler and fills a cup with whatever drink is currently in the cooler. These coolers are ideal for large groups, such as athletic teams.

Because such coolers are not generally designed for individual use, cups are needed for whoever wants to get a drink. One issue with serving a large number of people in this fashion is that a large number of cups must be available. Because these coolers are often used outdoors, such as on a sports field, many times no convenient location is available to store a large number of cups. In these situations, cups may be placed on a makeshift table, a bench or on top of the cooler where they are likely to be knocked down either by people or by the wind in outdoor environments. When cups are stacked upside down on such a table, someone trying to remove a cup from the top often accidentally removes multiple cups. This can be an inefficient use of cups and may be unsanitary when one person is handling a cup that will later be used by another person.

To reduce these problems, several cup-holding systems have been designed to work in conjunction with these large coolers. One example is a sleeve solution, which comprises a large cylinder that attaches to the side of a cooler and may be filled with cups. Cups are then pulled out from the bottom of the sleeve when someone wants a drink. This solution is fairly cumbersome and has a tendency to deform the cups when they are removed. Moreover, most of the coolers that have sleeves attached have these types of devices attached during manufacturing. Generally, the attachment is such that it cannot be used to retro-fit an existing cooler that does not have a cup dispensing apparatus or system.

Another solution is a cap coupled to or fitted on top of the lid of the large cooler. The cap system is designed to hold approximately a dozen filled cups on the top of the cooler. Some of these systems are also convenient in that the cap can be removed and used as a tray. However, such systems do not allow for the storage of a large number of cups as commonly used at, for example, a sporting event. Additionally, such a system is inconvenient to transfer with either empty or full cups along with the large beverage coolers, because these systems are designed to be moved without cups loaded when moving the cooler as well.

Moreover, one commonly used cooler has a large diameter lid that is positioned at the top of the cooler. The large diameter lid is helpful as it can be easily removed and large quantities of ice can be added through an opening that is generally the same size as the diameter of the container. By placing a cap or the like on the lid, the cap complicates removal of the lid to add ice or to refill the container. Since the cap is rather bulky and the cups are generally positioned on the top surface of the cap, removal of the cap often results in spilling of filled cups or cups being knocked to the ground.

Thus, there is a need for a cup holding system that overcomes the limitations of prior solutions. It is desirable that such a system be easy to use without wasting a number of cups and to be sanitary. In addition, such a system should be cost effective and not excessively cumbersome.

SUMMARY OF THE INVENTION

Accordingly, a system is disclosed which provides for the storage of a large number of cups in an easy-to-use and unobtrusive manner. The system is preferably designed for the stable holding of large stack(s) of cups without hindering the transport of the cooler.

In one embodiment, such a system comprises a ring or halo that fits around the lid and top portion of a large beverage cooler. Attached to the ring section is one or more cup holder sections that protrude externally from the radius of the beverage cooler. The cup holders comprise rings having a diameter sized such that they can hold a variety of different sized cups stably. A large number of cups may be stacked in the cup holder rings and extend upwards.

In another embodiment, the invention comprises a cooler body that is cylindrical having a first diameter wherein the cooler body has an opening at the first end. The cooler body receives a cooler lid, that is generally disk shaped having a first circumference at the first end. The cooler lid is preferably angled about its perimeter. In this embodiment, the invention further comprises a ring member defining a ring having an inner circumference that is substantially similar to the first circumference of the lid.

Preferably, the inner circumference of the ring member is also angled so that the engagement between the ring member and the lid results in the ring member being secured onto the lid and not extending downward past lid so as to cover the cooler body. In this way, items, such as handles, positioned on the cooler body are provided unobstructed access which allows a person to move the cooler with the ring member positioned thereon with less difficulty. The ring member further defines, in this embodiment, at least one holder member that is attached to the outer circumference of the ring member. The at least one holder member, in this embodiment, is preferably a ring member that defines an inner circumference that is substantially the outer circumference of a region of an angled cylindrical cup so that a first cup can be positioned in the holder member, with a plurality of cups stacked upwards thereon to maintain a supply of cups proximate the cooler body. Preferably, the holder member is sized so that between three quarters and two thirds of length of the cup is positioned below the ring defined by the holder member so that a plurality of cups can be securely positioned within the holder member.

From the foregoing, it will be appreciated that the embodiments disclosed herein provide a more efficient way of storing cups in conjunction with coolers and, in particular, coolers having large diameter lids. These and other objects and advantages of the present invention will become more apparent from the following description taken in conjunction with the accompanying drawings.

BRIEF DESCRIPTION OF THE DRAWINGS

Systems and methods which embody the various features of the invention will now be described with reference to the following drawings, in which.

DETAILED DESCRIPTION OF THE PREFERRED EMBODIMENT

Figure 1:
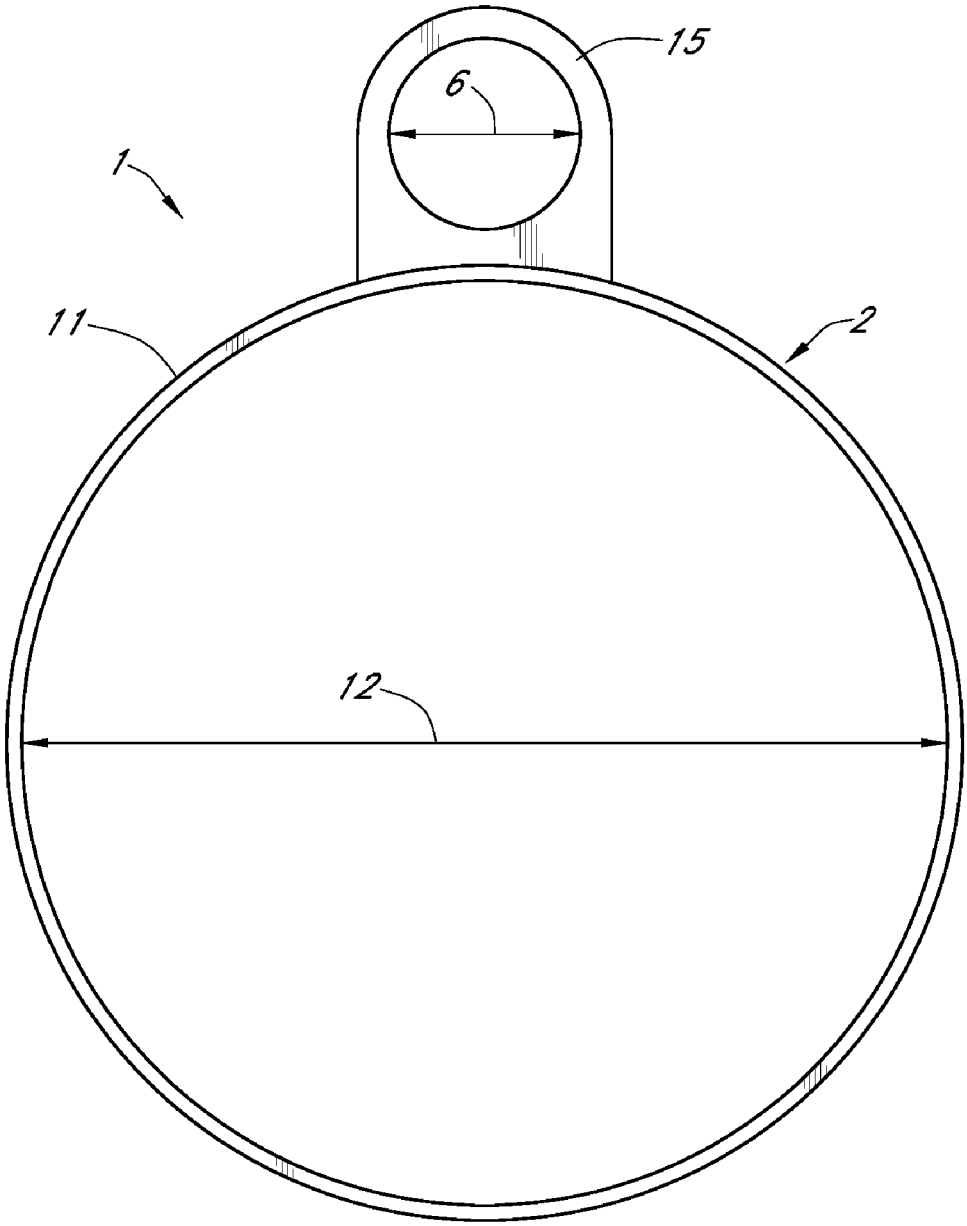
FIG. 1 is a diagram illustrating a cup holding system according to one embodiment of the invention.
Figure 2A:
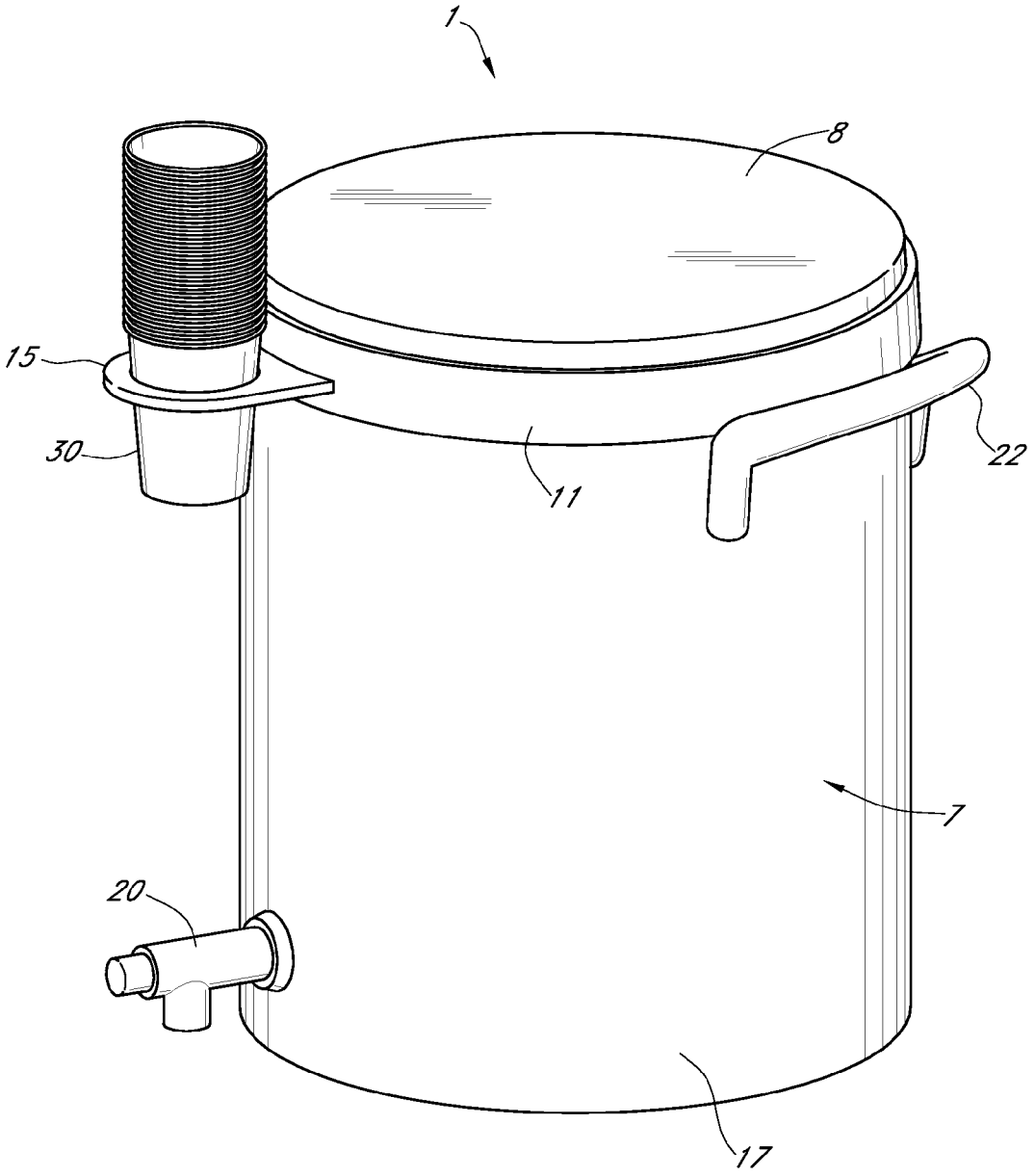
FIGS. 2A and 2B are drawings illustrating the cup holding system of FIG. 1 used in conjunction with a large round beverage cooler according to one embodiment of the invention.
Figure 2B:
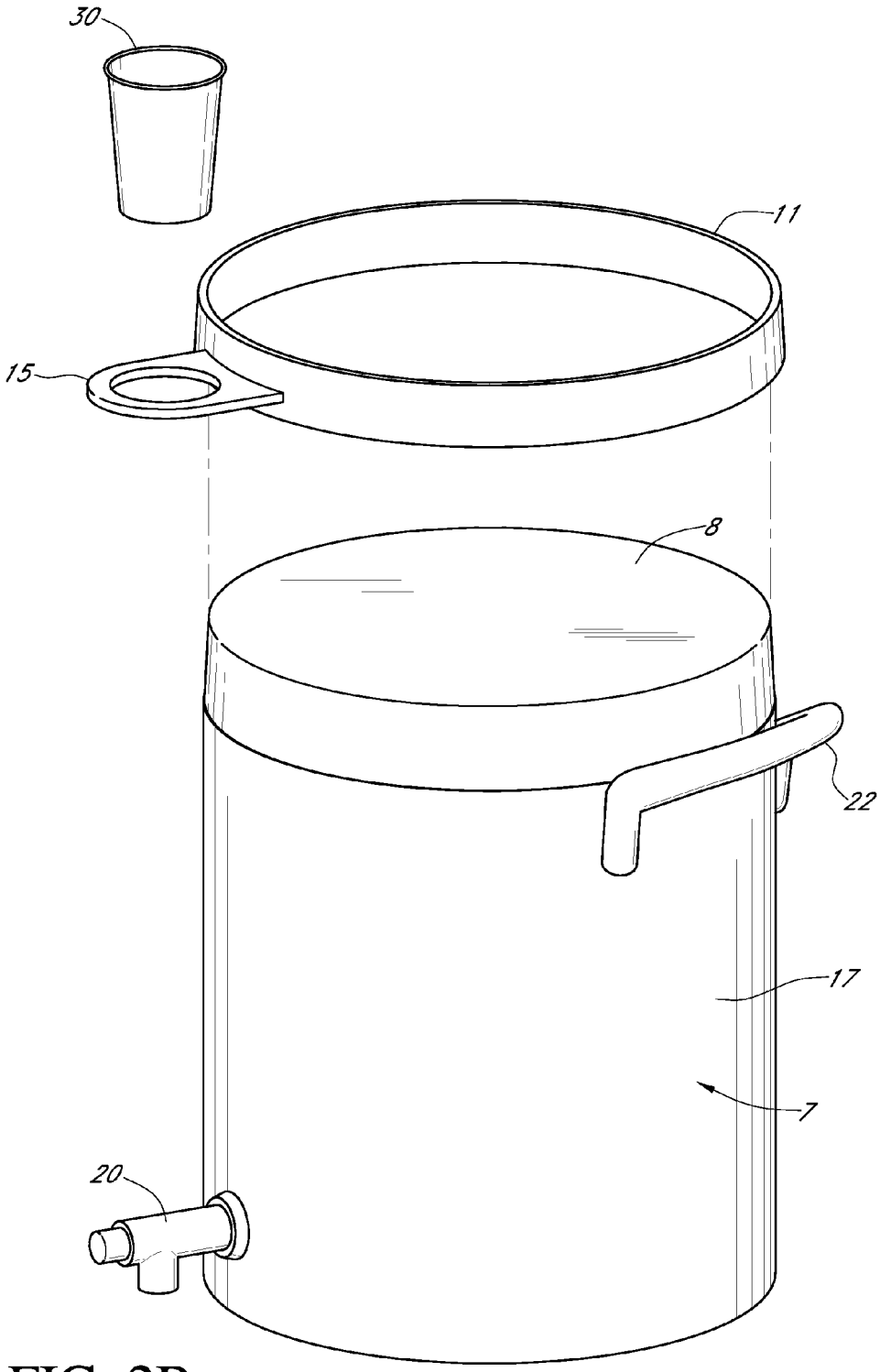

Reference will now be made to the drawings wherein like numerals refer to like parts throughout. FIGS. 1, 2A and 2B show a ring or halo system 1 according to one embodiment of the present invention. The halo system or holder assembly includes a large ring 11 having a diameter 12. The diameter 12 is preferably chosen such that the halo system, and specifically ring 11, fits snugly around a large beverage cooler 7 in the manner shown in FIGS. 2A and 2B. In some embodiments, diameter 12 is chosen to fit around a round 5-gallon beverage cooler 7. In some embodiments, the diameter 12 of ring 11 is chosen to fit around a round 10-gallon beverage cooler, or some sized cooler. In some embodiments, these diameters 2 of the ring 1 are approximately 10 13/16" for a 3-gallon version, approximately 12⅝" for a 5-gallon version, and approximately 15¾" for a 10-gallon version. As will be discussed in greater detail below, the ring 11 preferably is positioned about a lid 8 of the cooler 7.

Of course it will be understood that a variety of such coolers exist, and that some coolers of the same volume are produced by different manufacturers and have different physical characteristics. Nonetheless, it will be understood that the diameter 12 of the ring 11 may be adjusted to achieve the goals of the present invention when used with varying beverage coolers. In some embodiments, the ring 11 may be modified to fit coolers having a non-circular cross-section. In some embodiments, the height of ring 11 is chosen in conjunction with the diameter in order for the halo system to fit snugly around the top or lid of a particular water cooler 7.

Attached to the ring 11 is a smaller cup holder ring 15. Cup holder 15 protrudes radially outwards from the outer circumference of the ring 11. In the embodiment shown, the cup holder ring 15 is attached directly to the ring 11. In some embodiments, the position of the cup holder ring 15 relative to the ring 11 may be adjusted, for example, using an extension between the cup holder ring 15 and the ring 11. Cup holder ring 15, particularly the inner diameter 16 of cup holder 15, is sized to fit one or more style of cups. In some embodiments, the ring 15 may be sized to fit 8-ounce or 12-ounce disposable cups. In other embodiments, the ring 15 may be adapted to fit cups of different sizes. The term fit is used here to describe the state in which a cup rests stably within the cup holder ring 15. In general, a cup fits in the ring 15 when the diameter of the base of the cup is less than the diameter 16 of ring 15 and the diameter of the top of the cup is greater than the inner diameter 16 of ring 15. In some embodiments, the diameter 6 of ring 15 may be approximately 2¾". In some embodiments, the diameter 6 of ring 15 may be between approximately 2-3". In other embodiments, the diameter 6 of ring 15 may be some other value.

FIGS. 2A and 2B show one embodiment of a ring 11 in use with a large round beverage cooler 7. As shown in FIGS. 2A and 2B, the large round beverage cooler 7 has a base portion 17, a lid 8, spigot 20, and handles 22. The ring 11 of the halo system 1 is seen fitted around the outer circumference of the lid 8. This arrangement allows for the ring 11 to be positioned on the cooler 7 without interfering with access to the handles 22. It will be appreciated that the ring 11 can also be sized so as to fit about the upper portion 17 of the water cooler 7 to thereby allow the lid 8 to be removed without removal of the ring 11. Cup holder portion 15 is shown extending to one side radially outward, away from the cooler. In some embodiments, the ring 11 and the attached cup holder 15 are rotatable relative to the other features of the cooler. However, in some embodiments, the diameter 12 of ring 11 is such that when the ring 11 is in place on the cooler 7, the ring 11 fits tightly around the lid 8 of the upper portion of cooler body 10. This may allow for the rotation of the ring 11 when desired, while reducing the likelihood of the ring 11 being accidentally or unintentionally rotated.

In operation, one or more cups 30 are placed in ring 15 of the assembly. Additional cups 20 preferably stack inside the previously stacked cups. In some embodiments, approximately 50 cups may be stacked securely in this fashion. In some embodiments, any larger or smaller number of cups may be securely stacked, depending on the cup size and the size of cup holder ring 15. In some embodiments, the cup 30 is placed in cup holder 15 with at least half of its height below the cup holder ring 15. In some embodiments, cup holder ring 15 is designed so that a smaller cup, for example, an 8-ounce cup, will sit in cup holder ring 15 with approximately 80% of its height below the ring 15. The same diameter of ring 15 may hold larger cups, such as 12-ounce cups, with approximately 50% of their height below the cup holder ring 15. In general, the more of the cup 20 that sits below cup holder ring 15, the greater the stability of the stack of cups stacked on top of that base cup 30. With the stack of cups placed in cup holder ring 15, someone desiring to use the beverage cooler simply removes the top cup and pours the beverage from spigot 20.

In some embodiments, the cup holder 15 is advantageously rotated to enable for easy carrying of the cooler 7 and any cups 30 inserted in the cup holder 15. For example, as shown in FIG. 2A, ring 15 is rotated such that it does not overlap either of the handles 22, and will be away from the body of someone carrying the cooler. The assembly described herein, requiring only a small amount of (preferably lightweight plastic) material, adds little weight or inconvenience to the movement of the cooler while allowing for the easy carrying and storage of a number of cups for use with the cooler.

Figure 3:
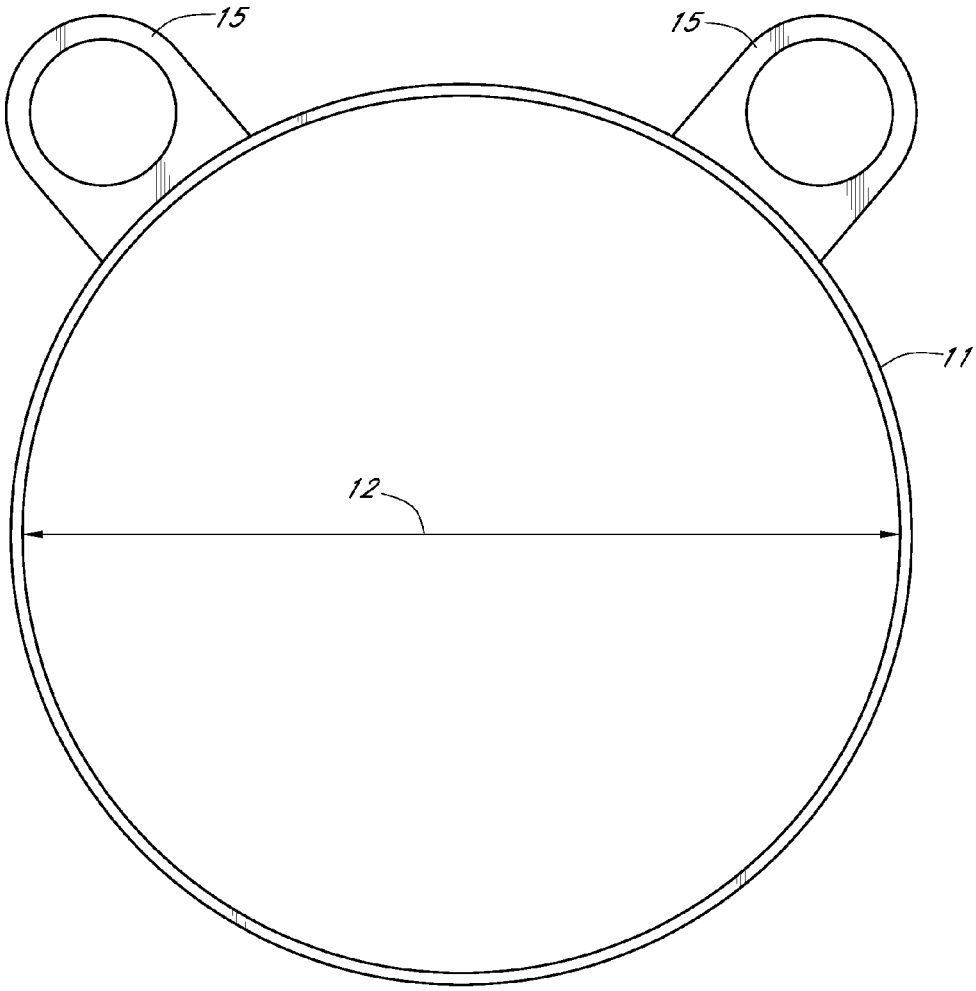
FIG. 3 is a diagram illustrating a cup holding system having multiple cup holding portions according to one embodiment of the invention.

FIG. 3 shows another embodiment of a halo cup holder system. The system of FIG. 3 contains a first ring 11 that fits around a large beverage container cooler as described according to the different embodiments above. As can be seen, the embodiment shown in FIG. 3 contains two cup holder rings 15. In the embodiment shown, the two cup holder rings 15 are spaced approximately 45° from one another. This embodiment advantageously allows for the easy carrying of the cooler as described above in addition to twice the number of cups, without having any protruding parts that might project into the body of the person carrying the cooler. In some embodiments, the rings 15 have identical diameters. In some embodiments, rings 15 have different diameters and they are sized to fit different size cups. In these embodiments, several variety of cups may be stored for use with the cooler. In other embodiments (not shown), different number of cup holder rings 15 may be attached to base ring 11 to store a larger number of cups or different types of cups.

Figure 4A:
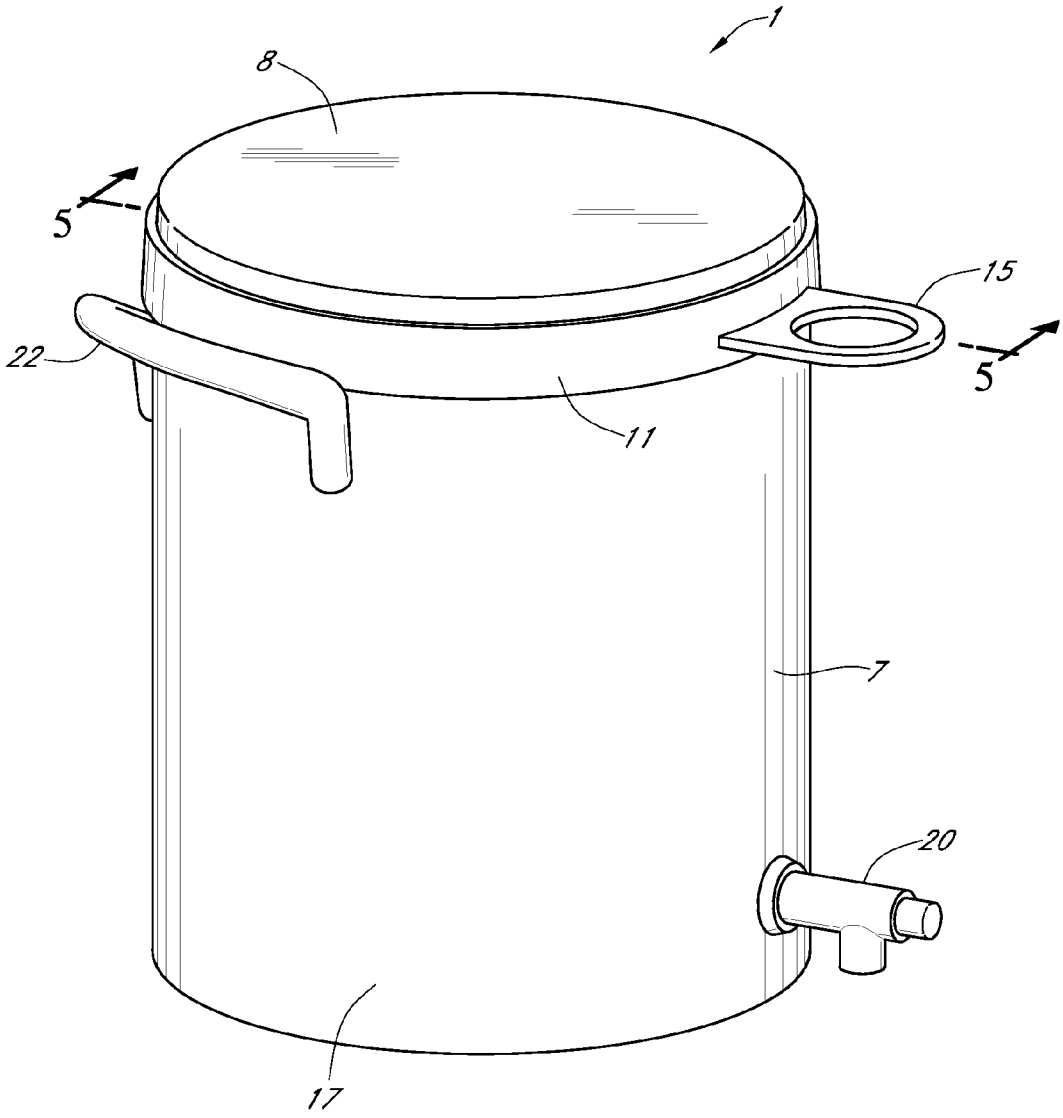
FIGS. 4A-4B are drawings illustrating several embodiments of a cup holding system of the current invention.
Figure 4B:
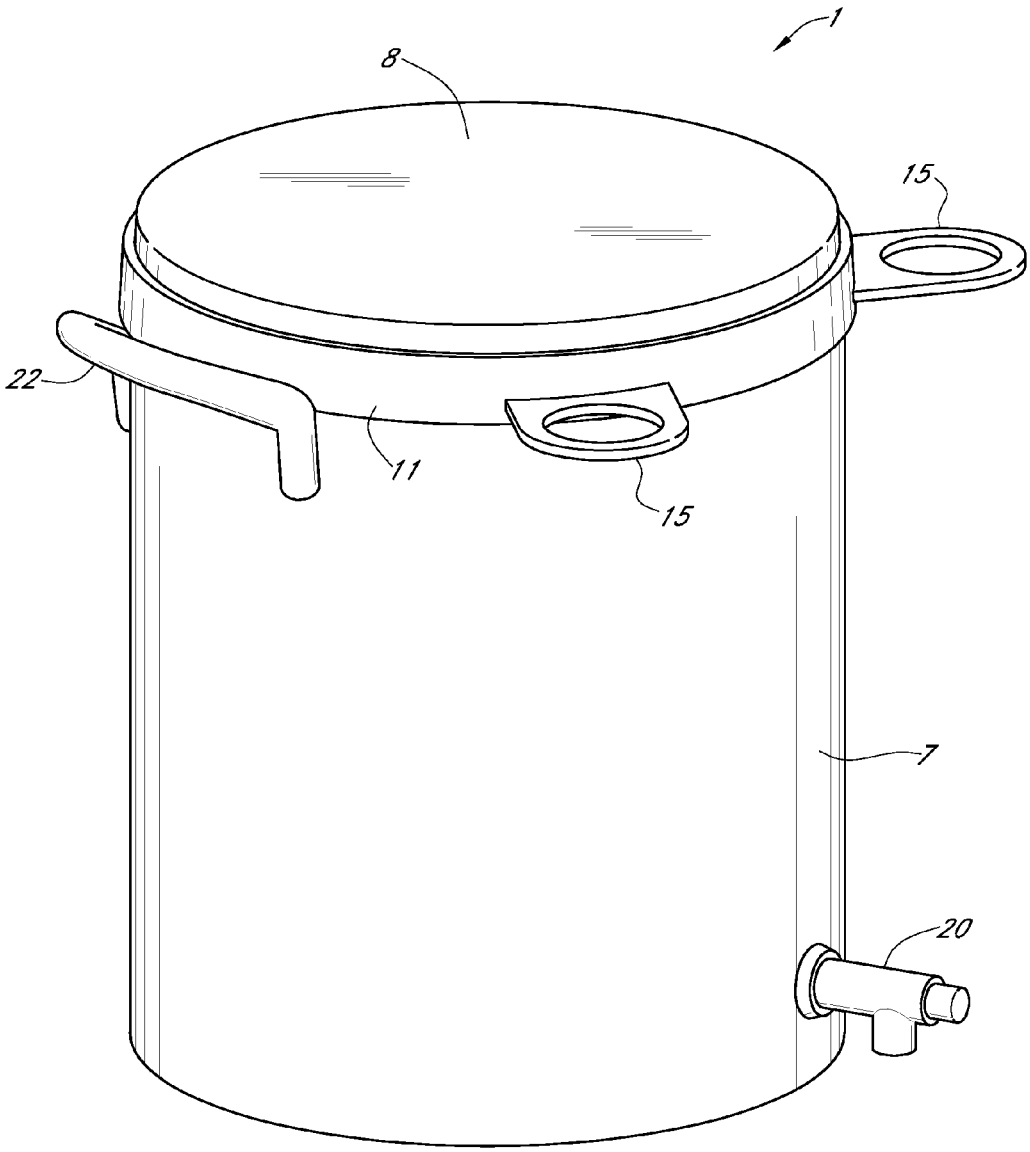

FIGS. 4A and 4B illustrate different possible configurations of the holder assembly 1. As shown, the holder assembly 1 of FIG. 4A can include a smaller cooler 7 and a smaller diameter ring 11 with only a single cup holder ring 15. As shown in FIG. 4B alternatively, the assembly 1 can also include larger coolers 7 with larger diameter ring member 11 with multiple cup holder rings 15. As is also shown in FIG. 4B, the holder rings 15 can be offset by a preselected angle, e.g., 45 degrees from each other so as to allow easy access to the spigot 20.

Figure 5:
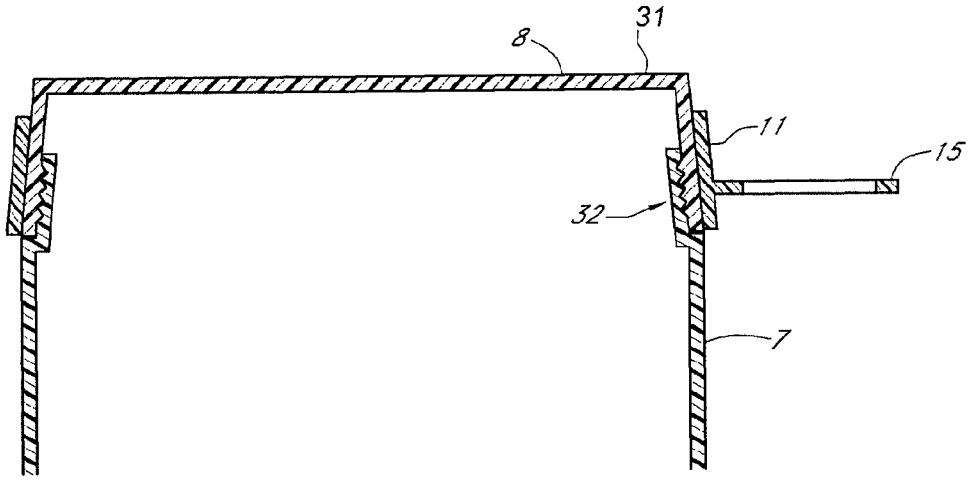
FIG. 5 is a cross-section of the cup holding system of FIG. 4A.

FIG. 5 is a cross-sectional view of the assembly 1 with a cooler 7 having a lid 8 with a ring assembly 1 mounted on the lid 8. Advantageously, the lid 8 is tapered so that the upper surface 31 of the lid 8 has a smaller circumference than the point of attachment between the lid 8 and the cooler 7 at the threads 32. Similarly, an interior surface 34 of the ring 11 is also preferably tapered to match the contour of the lid 8. In this way, the ring 11 is inhibited from sliding past down off of the lid 8. This allows for continuous access to the handles 22 of the cooler 8 while the holder is mounted on the cooler.

While certain embodiments of the inventions have been described, these embodiments have been presented by way of example only, and are not intended to limit the scope of the inventions. Indeed, the novel methods and systems described herein may be embodied in a variety of other forms. Furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A system for use with a round beverage cooler comprising:

a first ring having a first diameter and a first thickness and defining an outer portion;

a second ring attached to the outer portion of the first ring and having a second diameter and a second thickness which is less than the first thickness wherein the second ring defines an upper and lower surface;

wherein the first diameter of the first ring is sized such that the first ring may slide onto and stably rest on a top portion of the round beverage cooler; and the second diameter of the second ring is sized such that a cup may be inserted into the second ring and may be held in place by the second ring so as to be inhibited from removal from the ring via the bottom surface of the second ring and wherein the cup is exposed above the upper surface of the second ring so that the cup is removable from the ring adjacent the upper surface without the entire cup travelling through the second ring, wherein the first ring is sized to be positioned on a lid of the cooler, wherein the lid is tapered and wherein the first ring is tapered so that the first ring is maintained on the lid and is inhibited from being positioned on the body of the cooler by the engagement between the lid and the ring.

2. The system of claim 1, wherein the second diameter is further sized such that the cup may be inserted into the second ring with at least fifty-percent of the cup below a surface of the second ring.

3. The system of claim 1, further comprising a third ring attached to the outer portion of the first ring and having a third diameter, wherein the third diameter is configured such that a cup may be inserted into the third ring and may be held in place by the third ring.

4. The system of claim 1, wherein the first and second rings are made of plastic.

5. The system of claim 1, wherein the second ring is sized to receive 8 ounce paper or plastic cups with over 80% of the cup being positioned below the second ring.

6. The system of claim 1, wherein the second ring is sized to receive 12 ounce paper or plastic cups with over 50% of the cup being positioned below the second ring.

7. A drink dispensing apparatus comprising:

a cooler having a cylindrical body with a first and a second end, wherein a spigot is mounted adjacent a first end of the cylindrical body and at least one handle is mounted adjacent a second end of the cylindrical body and wherein a cylindrical opening is formed in the second end of the cylindrical body, the cylindrical opening being substantially the same size as the cylindrical body;

a lid that is cylindrical in shape an has an upper and lower edge, wherein the lid is positioned on the second end of the cooler wherein the lid is tapered such the lower edge of the lid has a greater circumference than the upper edge of the lid;

a first ring having a first thickness that mounts to the lid, wherein the inner circumference of the ring is tapered to match the taper of the lid so that the ring is maintained on the lid and distanced from the handles of the cooler;

a second ring having a second thickness less than the first thickness and an upper and lower surface that is attached to the first ring, wherein the second ring defines an opening that is sized so as to receive cylindrical drinking cups therein so that at least 50 percent of the bottom-most drinking cup is positioned in the opening beneath the second ring and wherein the cups are inhibited from removal via the lower surface of the second ring and are exposed adjacent the upper surface of the ring so that the cup is removable from the ring adjacent the upper surface without the entire cup travelling through the second ring.

8. The apparatus of claim 7, wherein the first and second rings are made of plastic.

9. The apparatus of claim 7, wherein the second ring is sized to receive 8 ounce paper or plastic cups with over 80% of the cup being positioned below the second ring.

10. The apparatus of claim 7, wherein the second ring is sized to receive 12 ounce paper or plastic cups with over 50% of the cup being positioned below the second ring.

11. The apparatus of claim 7, wherein the first ring is sized to be positioned on the lid of the cooler, wherein the lid is tapered and wherein the first ring is tapered so that the first ring is maintained on the lid and is inhibited from being positioned on the body of the cooler by the engagement between the lid and the ring.

* * * * *